United States Patent [19]

Nozawa

[11] Patent Number: 4,458,892

[45] Date of Patent: Jul. 10, 1984

[54] SIGNATURE DELIVERY DEVICES FOR USE IN ROTARY PRINTING PRESSES

[75] Inventor: Kenji Nozawa, Mito, Japan

[73] Assignee: Komori Printing Machinery Co., Ltd., Tokyo, Japan

[21] Appl. No.: 325,360

[22] Filed: Nov. 27, 1981

[30] Foreign Application Priority Data

Dec. 12, 1980 [JP] Japan ..... 55-174624

[51] Int. Cl.[3] ..... B65H 31/08

[52] U.S. Cl. ..... 271/202; 271/186; 271/212

[58] Field of Search ..... 271/212, 182, 186, 151, 271/237, 202

[56] References Cited

U.S. PATENT DOCUMENTS

| | | | |
|---|---|---|---|
| 3,436,073 | 4/1969 | Christmas . | |
| 3,690,650 | 9/1972 | Maier, Jr. et al. . | |
| 3,871,644 | 3/1975 | Stobb . | |
| 4,220,324 | 9/1980 | Weller | 271/151 |
| 4,364,552 | 12/1982 | Besemann | 271/182 |

*Primary Examiner*—Richard A. Schacher
*Attorney, Agent, or Firm*—Thompson and Birch

[57] ABSTRACT

In a signature delivery device in which signatures of paper sheets folded by a folding machine of a rotary printing press are conveyed by an endless conveyor belt to a horizontal type stacker in a partially overlapped state and at the stacker the signatures are inverted and then sequentially inserted beneath a stack of previously stacked signatures, there are provided a first roller in contact with a lower surface of the endless conveyor belt and rotated at a peripheral speed substantially the same as a running speed of the endless belt, a second roller mounted on a shaft in parallel with the first roller for clamping the conveyor belt and the signatures conveyed thereby between the first and second rollers, and drive gears for rotating the second roller at a peripheral speed lower than that of the first roller so as to slightly lay an upper sheet of each double fold signature with respect to the lower sheet. The amount of lag is made to be equal to the amount of advance of the lower sheet effected by a belt for successively inserting inverted signatures beneath the stack on the stacker.

4 Claims, 8 Drawing Figures

SIGNATURE DELIVERY DEVICES FOR USE IN ROTARY PRINTING PRESSES

BACKGROUND OF THE INVENTION

This invention relates to a delivery device for delivering signatures in a partially overlapped state, discharged from a folding machine of a rotary printing press and sent to a stacker wherein one of each double fold signatures is lagged in the direction of conveyance.

A web printing press is usually provided with a folding machine which cuts a web of printed paper into predetermined lengths and folds the cut lengths, and the folding machine is usually provided with a stacker which aligns and stacks signatures or sections sent thereto from the folding machine. The stackers are classified into vertical types in which signatures are stacked vertically and horizontal types in which the signatures are stacked horizontally.

FIG. 1 is a diagrammatic side view for explaining the conveyance of signatures to a horizontal type stacker and the stacking of the conveyed signatures on the stacker. The signatures 3 discharged onto a conveyor belt 2 by an impeller 1 provided for the paper discharger of a folding machine are overlapped one upon the other so that for example one signature 3B slightly overlaps the preceding signature 3A. The signatures 3 conveyed by the conveyor belt 2 in a partially overlapped state are clamped between a belt 6 passing about a rotary signature feeding cylinder 5 and an endless belt 7. As the belt 6 leaves the feeding cylinder 5, it runs beneath the stacker 4. At the stacker 4, the signatures are stacked such that each succeeding signature 3D is placed beneath a previously stacked signature 3C.

The signatures cut and folding by the folded machine can be of many different types depending upon the number of pages and the method of folding. Examples include type 3E shown in FIG. 2*a* in which two printed sheets each containing two pages are folded, and type 3F as shown in FIG. 2*b* in which two printed sheets each containing four pages are folded. The signatures 3E and 3F are discharged and conveyed in a partially overlapped state as shown respectively in FIGS. 2*c* and 2*d*. However, it should be understood that two printed sheets containing 2 or 4 pages constituting a single signature 3E or 3F are not displaced each other.

Where two fold signatures 3E or 3F are sent to the stacker 4 in a manner described above, the following troubles are encountered. More particularly, by taking the signature 3E as an example, when a succeeding signature 3E2 is inserted beneath a previously stacked signature 3E1 as shown in FIG. 3 the bottom sheet 3E2*a* constituting the lowermost signature is in contact with the paper feed belt 6 but the upper side sheet 3E2*b* is not in contact with the paper feed belt 6.

As a consequence these sheets are fed at different speeds so that the edges of the stacked sheets becomes offset and thus are not neatly aligned in the vertical direction. For this reason, it has been necessary to resort to frequent manual alignment of the bundle of signatures being stacked on the stacker.

SUMMARY OF THE INVENTION

Accordingly, it is an object of this invention to provide an improved signature delivering device for use in a rotary printing press for delivering signatures in an overlapped state capable of effectively and neatly stacking the signatures on a stacker, thereby eliminating manual alignment of the stacked signatures.

According to this invention there is provided a signature delivery device for use in a rotary printing press provided with a folding machine and a horizontal type stacker in which succeeding signatures are sequentially inserted by a belt beneath previously stacked signatures to form a vertical stack, the signature delivery device comprising an endless belt running between the folding machine and the stacker for conveying folded signatures, a first roller in contact with a lower surface of the endless conveyor belt and rotated at a peripheral speed substantially the same as the running speed of the endless belt, a second roller mounted on a shaft in parallel with the first roller for clamping the conveyor belt and the folded signatures conveyed thereby between the first and second rollers, and means for rotating the second roller at a peripheral speed lower than that of the first roller so as to slightly retard or lag one of the sheets of the double fold signatures in relation to the other sheets. The amount of lag of one sheet of each double fold signature the same as the amount of advance of the one sheet effected by the belt of the stacker.

DESCRIPTION OF THE PREFERRED EMBODIMENT

Figure 1:
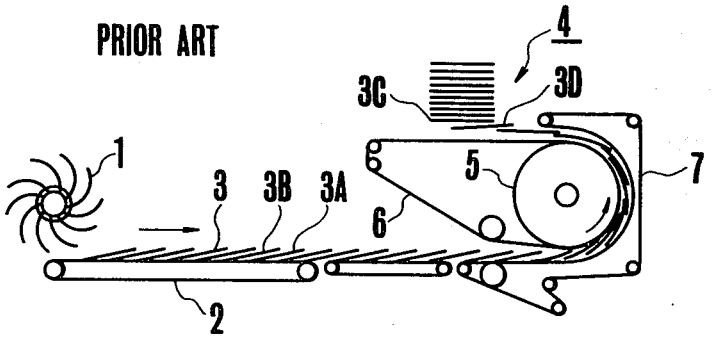
FIG.1 PRIOR ART
FIG. 1 is a diagrammatic representation of a prior art arrangement for explaining the conveyance of signatures to a horizontal type stacker and the stacking operation of the signatures thereon.
Figure 2:
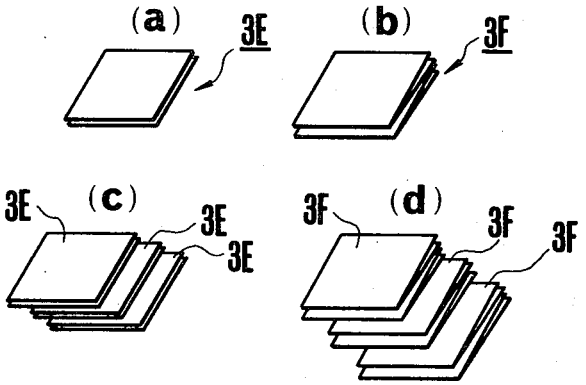
FIG.2 PRIOR ART
FIGS. 2*a* through 2*d* are perspective views showing various types of signatures and manners of overlapping.
Figure 3:
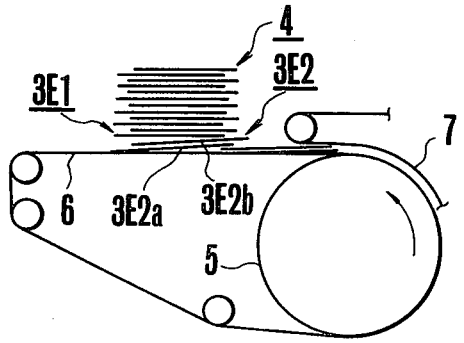
FIG.3 PRIOR ART
FIG. 3 is a side view showing a manner of stacking signatures on a prior art horizontal type stacker.

A preferred embodiment of the signature delivery device according to this invention will now be described with reference to FIGS. 4 and 5. The signature delivery device shown therein includes spaced apart angle supports 12 secured to the base 11 of a folding machine, not shown, and a pair of vertical brackets 13 supported by the supports 12 for supporting a belt roller 14 through ball bearings, not shown. A sprocket wheel 16 is mounted on one end of the belt roller 14 which is connected with a driving device for the folding machine through a chain 15 so as to rotate the roller 14 in the clockwise direction G as viewed in FIG. 4. A plurality of endless conveyor belts 17 running in a direction H between the impeller 1 of the signature delivery device and the stacker 4 which have been described with reference to FIG. 1 are provided in contact with the periphery of the roller 14. The running speed of the conveyor belts 17 equals the peripheral speed of the roller 14.

Figure 4:
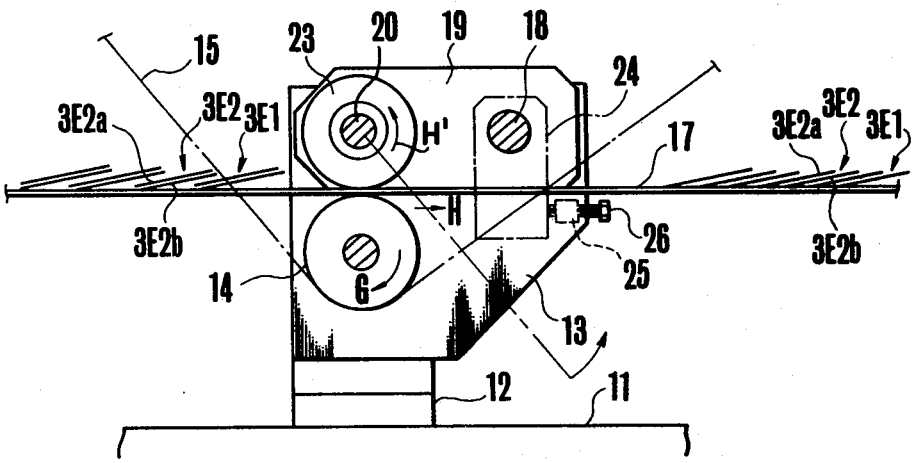
FIG. 4 is a side view showing a device for delivering signatures in a partially overlapped state embodying the present invention and utilized in a rotary printing press.
Figure 5:
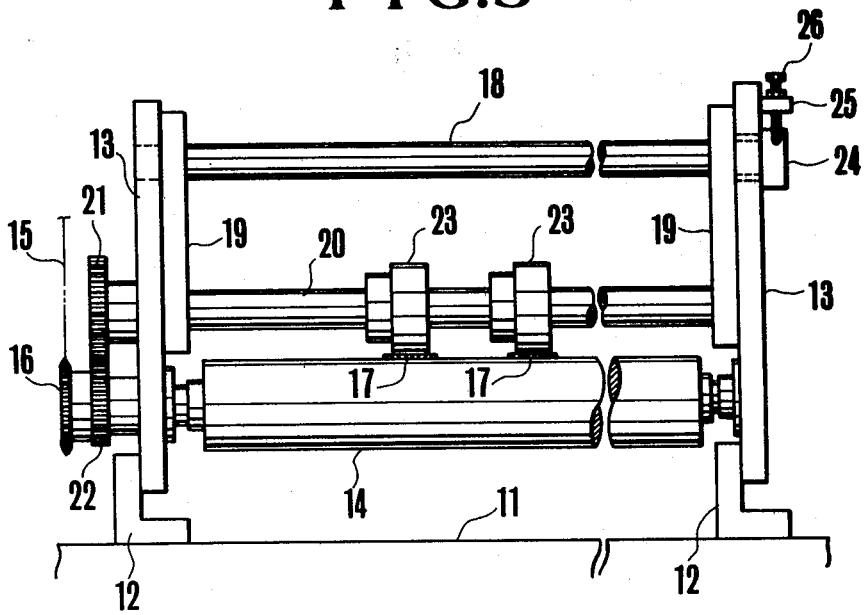
FIG. 5 is a front view of the signature delivery device shown in FIG. 4.

A pair of rectangular arms 19 are secured to the opposite ends of a shaft 18 mounted on the upper right side of the roller 14 (see FIG. 4). The arms 19 are maintained in contact with the brackets 13 and rotatably support a roller shaft 20 at their lower ends. A gear 21 is mounted on one end of the roller shaft 20 to mesh a gear 22 integral with the sprocket wheel 16. Furthermore, a plurality of rollers 23 with their surfaces covered by an elastic material such as rubber are mounted on the roller shaft 20. These rollers 23 are biased against the conveyor belts 17 by their own weight and their rotation about the roller shaft 20, and rotated in the counterclockwise direction H' as viewed in FIG. 4 by gears 21 and 22. These rollers 23 have substantially the same diameter as that of the roller 14 and are rotated at a lower peripheral speed than that of the roller 14 by suitably selecting a gear ratio between the gears 21 and 22. Levers 24 are secured to both sides of the shaft 18 to receive adjusting screws supported by projections 25 secured to the brackets 13. (For the sake of simplicity only one set is shown) Thus, by rotating the adjusting screws 26 it is possible to adjust a gap between the rollers 23 and the conveyor belts.

The operation of the signature delivery device according to this invention will now be described with reference to FIGS. 1 through 5. In this example, two page double fold signatures are delivered and conveyed. Thus, signatures 3E1, 3E2 . . . cut and folded by the folding machine are delivered and conveyed in a partially overlapped state. Before entering into the delivery device shown in FIG. 4, in the case of a signature 3E2, the lower edges of the upper sheet **3E2*a* and the lower sheet 3E2*b* are aligned. Under these conditions the signatures are fed into the gaps between the rollers 23 and the conveyor belts 17. Since the rollers 23 are rotated at a lower peripheral speed than the running speed of the conveyor belts and the peripheral speed of the roller 14, a braking force is applied to the upper sheet 3E2*a* to decrease the speed thereof in relation to that of the lower sheet 3E2*b*. Consequently, the signatures 3E1, 3E2 . . . outputted from the signature delivery device have their upper and lower sheets displaced relative to each other. As the signatures are conveyed to the stacker under these conditions, the relative positions of the upper and lower sheets are inverted. Thus, in the case of the signature 3E2, the sheet 3E2*b* is brought to the upper side. When the succeeding signature 3E2 is inserted by the conveyor belt 6 (see FIGS. 1 and 4) beneath previously stacked signature 3E1, as above described, the sheet 3E2*a* in contact with the belt 6 is conveyed thereby so that the sheet 3E2*a* would be advanced with respect to the sheet 3E2*b* not in contact with the belt 6. However, since the sheet 3E2*a* of the signature 3E2 has been lagged relative to the sheet 3E2*b* by the signature delivery device, the advance of the sheet 3E2*a* effected by the belt 6 cancels the lag of the sheet 3F2*a* effected by the signature delivery device with the result that the edges of the upper and lower sheets 3E2*a* and 3E2*b*** are neatly aligned and then the signatures are neatly stacked in the vertical direction.

Where the thickness of the paper sheet is varied or where the type of the signature is changed, for example, from the two page double fold signature 3E to the four page double fold signature 3F, it is necessary to vary the gaps between the rollers 23 and the conveyor belts 17 by rotating the adjusting screws 26. Such adjustment can be made readily while observing the state of the stacked signatures.

As above described, according to this invention there is provided a signature delivery device between a folding machine of a rotary printing press and a horizontal type stacker for slightly lagging one of the sheets of double fold signatures with respect to the other sheet. As a consequence, the relative displacement between the upper and lower sheets of the signatures caused by a belt provided for the stacker is cancelled by the lag provided by the signature delivery device so that the edges of the signatures stacked on the stacker are neatly aligned in the vertical direction, thereby eliminating manual alignment of the stacked signatures.

What is claimed is:

1. A signature delivery device for use in a rotary printing press provided with a folding machine and a horizontal type stacker in which succeeding double sheet signatures are sequentially inserted by a belt beneath previously stacked multiple sheet signatures to form a vertical stack, said signature delivery device comprising:

an endless belt running between said folding machine and said stacker for conveying double sheet signatures;

a first roller in contact with a lower surface of said endless belt and rotated at a peripheral speed substantially the same as the running speed of said endless belt;

a second roller parallel with said first roller, said conveyor belt and said double sheet signatures conveyed thereby being clamped between said first and second rollers, and means for rotating said second roller at a peripheral speed lower than that of said first roller so as to slightly lag one of two sheets constituting said double sheet signatures in relation to the other sheet thereof.

2. The device according to claim 1 wherein an amount of said lag of one sheet is the same as an amount of advance of said one sheet effected by said belt of said stacker.

3. The device according to claim 1 which further comprises means for adjusting the gap between said second roller and said endless belt.

4. The device according to claim 1 which includes a plurality of said endless belts and a plurality of said second rollers mounted above said endless belts.

* * * * *